US008087208B2

(12) United States Patent
Quintile et al.

(10) Patent No.: US 8,087,208 B2
(45) Date of Patent: Jan. 3, 2012

(54) FRAME MEMBER FASTENING DEVICE AND METHOD OF MANUFACTURE

(76) Inventors: Mark Quintile, Brunswick, OH (US); Michael Bittner, Ashtabula, OH (US); Dale Maynard, Mentor, OH (US)

( * ) Notice: Subject to any disclaimer, the term of this patent is extended or adjusted under 35 U.S.C. 154(b) by 443 days.

(21) Appl. No.: 12/241,772

(22) Filed: Sep. 30, 2008

(65) Prior Publication Data

US 2010/0077694 A1 Apr. 1, 2010

(51) Int. Cl.
*E04B 1/38* (2006.01)
*E04C 5/00* (2006.01)

(52) U.S. Cl. ..... 52/713

(58) Field of Classification Search ..... 52/126.1, 52/126.2, 126.3, 126.4, 698, 710, 712, 713, 52/714, 715, 211, 213; 72/363; 248/188.2; 49/504, 505

See application file for complete search history.

(56) References Cited

U.S. PATENT DOCUMENTS

| | | | | |
|---|---|---|---|---|
| 3,445,977 | A * | 5/1969 | Latiano | 52/713 |
| 4,222,209 | A | 9/1980 | Peterson | |
| 4,570,406 | A | 2/1986 | DiFazio | |
| 5,186,571 | A * | 2/1993 | Hentzschel | 403/231 |
| 5,412,920 | A * | 5/1995 | Hess | 52/712 |
| 5,485,705 | A | 1/1996 | Guillemet | |
| 5,881,525 | A | 3/1999 | Riegelman et al. | |
| 5,921,056 | A | 7/1999 | Weiss et al. | |
| 6,119,416 | A | 9/2000 | Larson | |
| 2004/0118074 | A1 * | 6/2004 | Quintile | 52/713 |

OTHER PUBLICATIONS

Deansteel Manufacturing Company Inc., San Antonio, Texas, pp. 1-11, Sep. 2001.

* cited by examiner

*Primary Examiner* — Eileen D Lillis
*Assistant Examiner* — Theodore Adamos
(74) *Attorney, Agent, or Firm* — Roetzel & Andress

(57) ABSTRACT

A frame member fastening device and method of manufacture provides a single configuration fastening device which can be used singly in connection with a frame member, or which can be combined with another identical fastening device to form a fastening device assembly for use with frame members of different internal widths, by interlocking two identical fastening devices in an opposed, base-to-base assembly configuration. The fastening device is manufactured in a progressive metal forming process with successive stages in which the features of the device are formed.

6 Claims, 2 Drawing Sheets

FRAME MEMBER FASTENING DEVICE AND METHOD OF MANUFACTURE

FIELD OF THE INVENTION

The present invention is in the field of construction fastening devices and systems, and methods of manufacture thereof, for installing and securing construction member such as steel studs and door frames and other types of structural members.

BACKGROUND OF THE INVENTION

Construction members such as steel studs and door flames are made of different types of channels and frames which must be secured to other building members such as wall construction studs. This requires the use of many different types of fasteners. Doorways are made in wall construction by the use of pre-fabricated frames, such as steel channel frames which are fastened or anchored to wood or metal studs. Door frames are attached to wall studs with fastening or fastening devices by nails or screws. One type of anchor device is in the form of a box-shaped structure with a front wall and side walls and a size and shape that corresponds to an interior profile of a door frame member providing a door jamb. A plurality of frame fasteners are mounted on studs around the door frame, in order to anchor the door frame to form a door jamb. Door frame members are made in a large number of different sizes in which the width of the channels may vary. Different size fastening devices are needed to accommodate each specific door frame size. However, due to the many different types of building components such as door frames, this approach requires many different fastening devices, each of which require separate tooling and packaging, resulting in increased costs. Also, a separate inventory must be maintained for each specific fastening size, resulting in additional storage and other expenses.

In order to overcome these inefficiencies, adjustable frame fasteners have been devised. A two-piece fastener of this type is essentially formed of two half-pieces, each piece having a front wall and only a single side wall. The half-pieces are adjustably connected so that the end walls define the width to fit within a door frame member. The width of the anchor can be adjusted by varying the end-to-end spacing between the end walls. In this manner, the two-piece fastener design can be used with a range of door frame widths. However, this design requires two parts for each door frame fastener. This effectively doubles the expense of each door fastener, since double the material is required, along with doubling the manufacturing, inventory and shipping expenses and assembly. The majority of doorjamb applications are for only one standard size. Therefore, the two-piece fastener system is not the most economical for a large percentage of installations.

SUMMARY OF THE INVENTION

In accordance with one aspect of the invention, there is provided a fastening device for securing a frame member to a support member, the fastening device including a base platform having a plurality of edges; an attachment wall which extends from an edge of the base platform, the attachment wall configured for attachment to the support member; an opposing wall which extends from an edge of the base platform for positioning proximate to the frame member; first and second end walls which extend from generally opposite edges of the base platform for positioning proximate to generally opposed surfaces of the frame member, a tab connector extending from each of the first and second end walls and configured for connection of the fastening device to another fastening device.

In accordance with another aspect of the invention, there is provided a fastening device that includes a base platform, an attachment wall which extends from the base platform; first and second end walls located at ends of the base platform; the first end wall defining a first end of the anchor device for placement proximate to a first surface of a member to be anchored by the fastening device, and the second end wall defining a second end of the anchor device for placement proximate to a second surface of the member to be anchored by the fastening device, and a first connection tab extending from the first end wall and a second connection tab extending from the second end wall, the first and second connection tabs configured for engagement with a second fastening device by insertion through correspondingly located first and second slots in a base platform of the second fastening device.

Although the invention is described with reference to a particular representative embodiment, the principles and concepts of the invention and related inventions may be embodied in equivalent forms which are within the scope of the claims and equivalents.

DESCRIPTION OF PREFERRED AND ALTERNATE EMBODIMENTS

Figures 2A, 2B:
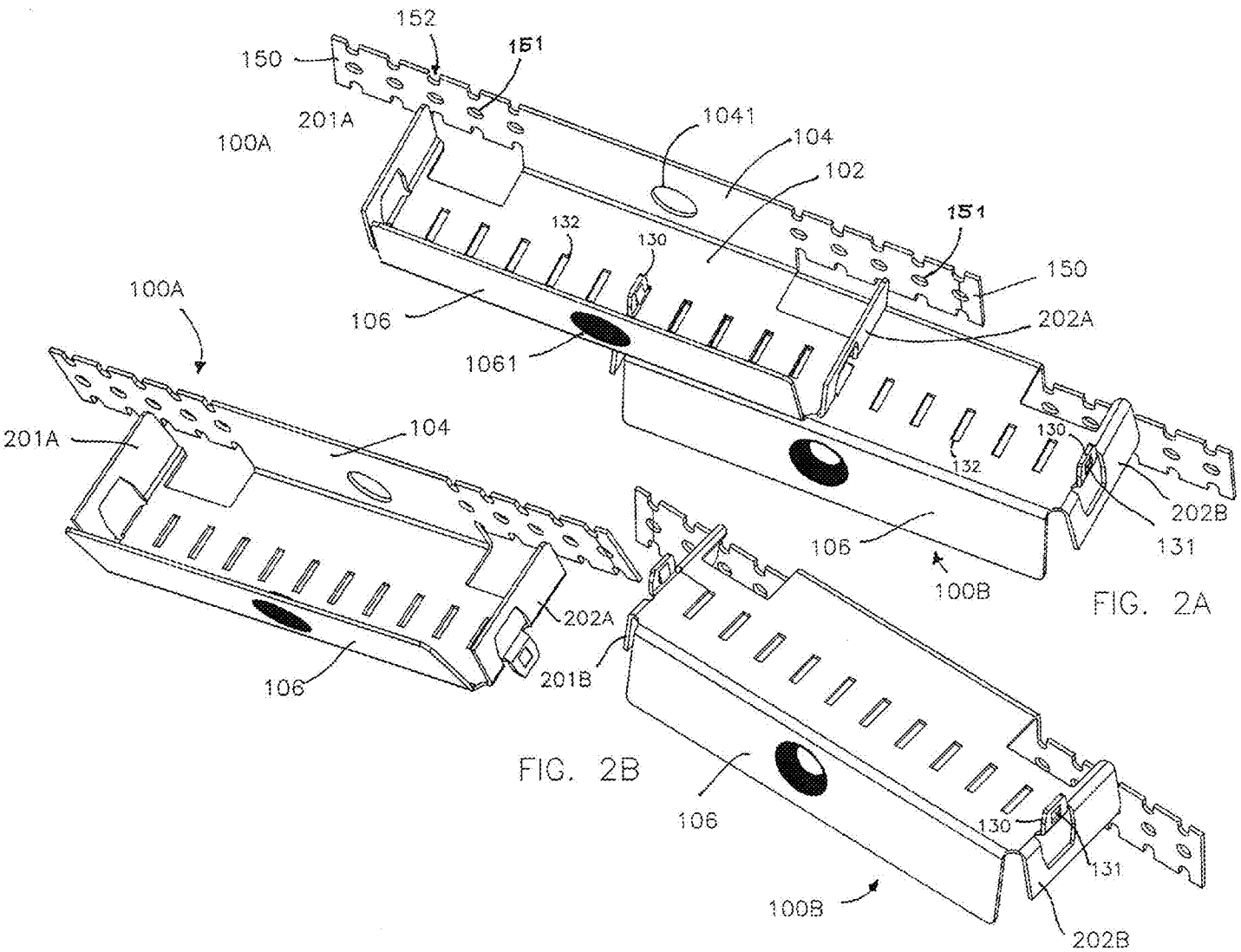
FIGS. 2A and 2B are perspective assembly views of first and second cooperating fastening devices of the present disclosure and inventions.

FIGS. 2A and 2B depict a fastening devices 100A and 100B (also referred to herein singularly as a "fastening device 10") fabricated in accordance with the system and method of the disclosure and related inventions. Each fastening device 100 has a base 102. An attachment or strap wall 104 is configured to extend from the base 102, for attachment to a structural support member such as a wood or metal stud, or any other type of support member used to define a door frame for supporting a door jamb, or to any other structural member in a building or machine, generally and collectively referred to herein as "second member" or "support member". The strap wall 104 can include any structure for securely attaching to a second member such as a wall stud. In the preferred embodiment, the strap wall 104 is formed along and extending from an edge of the base 102. A strap member 150 extends from the strap wall 104 and can be wrapped around a second member or stud and secured. The strap member 150 preferably includes one or more attachment features or structures 151, such as holes for receiving one or more fasteners, e.g. nails or screws, for attachment to a wall construction stud or other type of second member, and aligned notches 152 for facilitating bending of the strap member 150 along various transverse lines between the aligned notches 152.

The fastener device 100 further includes first and second end walls 201, 202, located at respective lateral ends of the base 102. As shown in the figures, the end walls 201, 202 are formed generally perpendicular to the plane of the base 102, but may also be slightly less than perpendicular or canted outward from the base 102 for an angular interference fit with the interior surfaces of a frame member. The end walls 201, 202 define first and second ends of the fastener device 100, and a combination assembly of two fastener devices 100, as further explained.

An opposing wall 106 extends from the base 102, opposite the strap wall 104. The opposing wall 106 provides a structure for contact with an interior of a door frame channel. The opposing wall 106 also extends generally perpendicular from the base 102, or less than perpendicular and canted slightly outward for an interference fit with an interior of a frame member. Formed in the attachment or strap wall 104 is a trough-hole 1041 which is generally aligned with a countersink through-hole 1061 formed in the opposing wall 106 for receiving a fastener such as a nail or bolt for attachment of the fastening device to a supporting structure.

A frame member with which the fastening device fits may also be generally referred to as a "first member" or "frame member", or may be a door frame jamb (vertical member) or header (horizontal member). Other than a door frame channel or member, the first member may be any piece, part, structure, member or device which is attached or connected to a second member by fastener device 100. In the preferred embodiment, the opposing wall 106 is generally parallel to the strap wall 104 or has a slight taper, or angle of a few degrees relative to the base 102. Both are generally perpendicular to the plane of the base 102 and also to the end walls 201, 202. In the preferred embodiment, the base 102, the strap wall 104, the end walls 201, 202 and the opposing wall 106 are all stamped or otherwise formed as a single, integrated piece of metal or other suitable material, in a stamping process and method as further described. However, each of the component parts of the fastener device 100 can be made separately and assembled together.

The fastener device 100 further includes elements for connection of one fastener device 100 to an identical fastener device 100, as shown for example in one combination configuration in FIG. 2A. One type of connection between identical anchor devices 100 is formed in the base 102, so that the base platforms 102 of two fastener devices 100 are connected in a back-to-back abutting arrangement, as shown in FIG. 2A. The interconnection of two fastening devices 100 is preferably by a tab and slot arrangement in which a tab 130 is formed from each of the end walls 201, 202. One or more cooperating slots 132 are formed in the base 102 so that at least one of the tabs 130 from one fastener device 100 is received within a slot 132 of another fastener device 100, in the back-to-back arrangement shown in FIG. 2A.

In the frame fastening system shown in FIG. 2A, a first fastening device 100A is connected to a second fastening device 100B in a generally opposed arrangement, wherein the respective base platforms 102 are in planar contact, that is, they are generally flush against each other, and wherein the end walls of the combined fastening devices extend in opposite directions. The cooperating fastening devices 100A and 100B in one configuration may be generally aligned, that is the base platforms 102 of each of the fastening devices 100A, 100B may be generally aligned at the perimeters and end-to-end, so that the respective end walls of the fastening devices are generally aligned. This provides a double fastening device for increased anchoring strength.

Alternatively, the combination may be configured with the base platforms 102 laterally offset, as shown in FIG. 2A wherein the lateral extent, or total width of the fastening device assembly 100A, 100B, as defined by the opposing side walls 201A and 202B is increased for use with wider width door frames. The fastening devices 100A and 100B are connected in a laterally offset arrangement so that one of the side walls 201, 202 from one fastening device 100A or 100B defines a first end of the fastening assembly and an opposing side wall 201, 202 of another fastening device 100A or 100B defines a second end of the fastening assembly. For example, as shown in FIG. 2A, side wall 201A forms one lateral end of the fastening assembly, and side wall 202B forms an opposite lateral end of the fastening assembly. The opposing lateral ends of the fastening assembly, as defined by side walls 201A and 202B fit in the interior of a channel or frame member, such as a door frame jamb or header, in order to secure the door frame member to a supporting structure such as a wall, or more specifically to a wall stud, by for example attachment of the strap members 150 to a wall stud, such as a wooden or metal wall stud.

The width of the fastening device 100 can be selected by inserting tab 130 of one fastening device 100 into a respective slot 132 of an opposing fastening device 100. The tabs 130 are preferably configured with a locking lance 131 which protrudes from a surface of the tab 130 to lock the tab within a slot 132. As shown in FIG. 2A, the fastening devices 100A and 100B can be connected in this manner to provide an anchor system with a combined total width of, for example, 6.25 inches. The fastening devices 100A and 100B can be connected in this manner to provide a fastening system with a greater total assembled width such as, for example, 8.75 inches. Intermediate widths, for example 6.75, 7.25, 7.75 or 8.25 inches can be provided with a six-slot arrangement, as illustrated, but any widths can be provided by a suitable number and spacing of slots, all within the scope of the invention.

In another embodiment of the invention, a single fastening device 100 can be used as the entire fastening system for a particular frame member at a particular location along a length of the frame member. In one particular embodiment, the distance between the first and second end walls 201 and 202 is, for example, 5.75 inches. The fastening device 100 can be attached by straps 150 directly to a stud in order to anchor a door frame which has a channel which is 5.75 inches wide. As illustrated, the fastening devices 100 can be used singly and in combination to provide at least eleven (11) different sizes to fit with and within frame members of different widths and dimensions. The fastening device and door frame dimensions are exemplary only and the invention is not limited to these particular dimensions.

Figure 1:
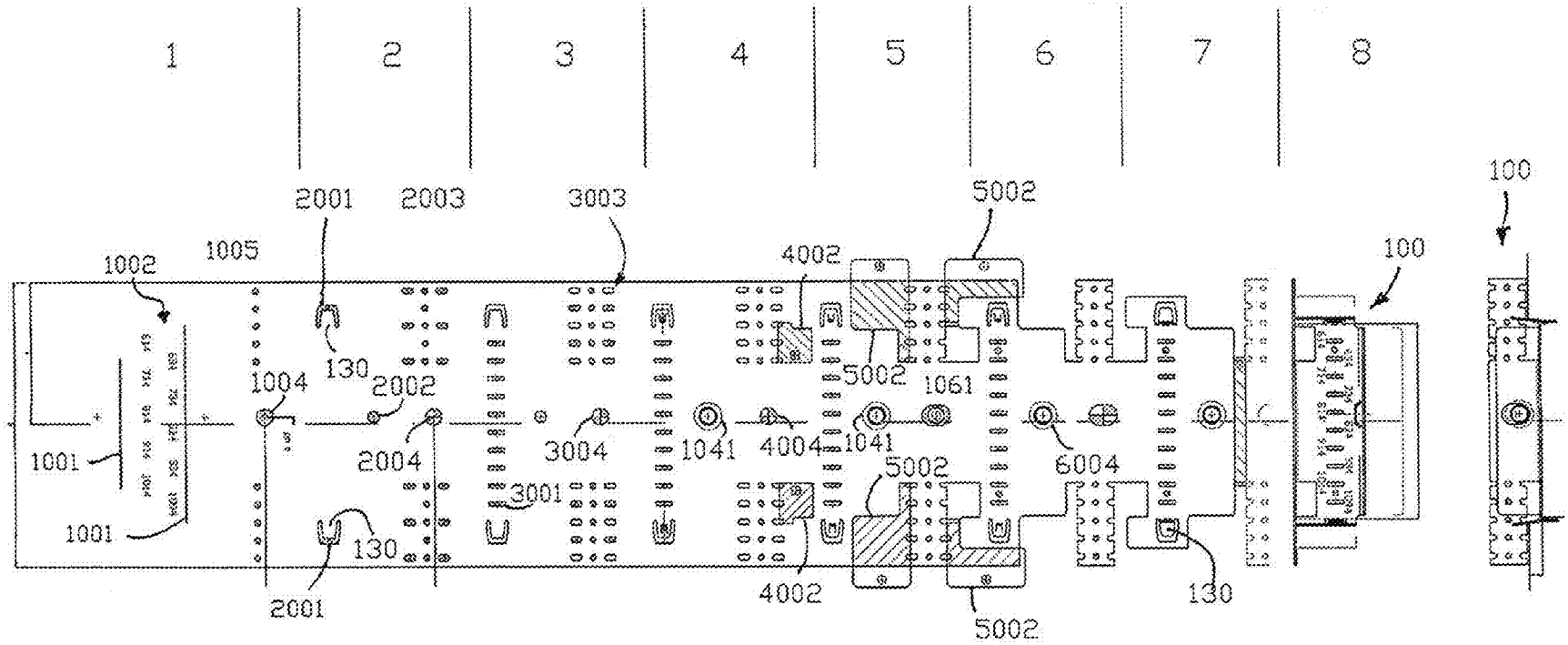
FIG. 1 is a plan view of a progressive metal forming operation and sequence of the present disclosure and inventions.

A method of manufacturing the frame fastening device 100 from metal uses a progressive stamping operation in which successive stamping operations form the described physical features of the device. As shown in FIG. 1, a progressive type die is configured with multiple stations at which different operations on a metal blank are performed in order to create the fastening device 100.

The various stages of production are generally indicated as stages or stations 1-7, and stage or station 8 at which the formation of a fastening device 100 is completed.

At station 1, the indicated scoring lines 1001 for bends are formed, stenciling size numbers, as shown at 1002, for fastener assembly width dimensions, piercing nail holes 1003, and formation of a pilot hole 1004 (for progression alignment).

At station 2, notches 2001 are made for the tabs 130, a pierce 2002 is made for the through-bolt countersink, a first set of piercings 2003 are made for strap cutouts 152, and pilot 2004 for advancing the strip in a feed progression in a range of 4.3 to 4.6 inches, which is the approximate distance for advancement of the metal blank between each of the stations. The feed distances may vary between any of the pilots, ±0.1 to 2.3 inches of the set feed amount. At station 3, piercings 3001 are made to form the adjustment slots 132 and which correspond to the stenciled adjustment sizes, and a second set of piercings 3003 are made for the strap cut-outs 152, and pilot 3004.

At station 4, the lances 131 of the locking tabs 130 are formed; forming of the countersink 1061 for bolt attachment through a cross-section of the fastener; notches 4002 for the part parameter (big end notches at side walls) for channel clearance (jamb and header), and pilot 4004

At station 5, additional clearance is cut for through-bolt holes 1041 and 1061, cutting clearance for bolt, and notches 5002 are formed proximate to strap members 150.

At station 6: pilot 6004 is established, which may be a pilot at idle.

At station 7, the adjustment tabs 130 are bent down, and the fastener device lateral profile is cut as shown.

At station 8, the four walls of the fastener device are formed or bent up, as also shown in profile.

A frame fastening system is thus provided in which a one-piece universal fastening device is used to engage and anchor a door frame, door frame member or other member or construction components or pieces of a wide range of dimensions. The one-piece universal fastening device system can optionally be expanded to provide a greater door frame or member widths. With device and assemblies of the invention, it is not necessary to manufacture and stock a number of different fastening device door anchors. Also, it is no longer necessary to be limited to a two-piece anchor for every specific width. Therefore, the present invention offers greater versatility and efficiency, and can reduce the costs of manufacturing, inventory and shipping. Thus, the present invention offers superior results over those obtained using previous-type anchor systems.

As described, the present invention provides a novel anchoring system adaptable to many different dimensions, applications and installations. Alterations and variations in the details, materials and arrangements of parts of the invention as described and illustrated are within the scope of the invention as defined by the claims and equivalents thereof.

What is claimed is:

1. A fastening device for fastening a frame member to a support member, the fastening device comprising a base having a plurality of edges; an attachment wall which extends perpendicularly from an edge of the base platform, the attachment wall further comprising straps which extend laterally from the attachment wall and configured for attachment to the support member; an opposing wall which extends from an edge of the base platform generally parallel and opposed to the attachment wall for positioning proximate to the support member; first and second end walls which extend perpendicularly from generally opposite edges of the base platform and which are generally perpendicular to the attachment wall and to the opposing wall, for positioning proximate to generally opposed surfaces of the frame member, first and second tab connectors each extending from the base, the first tab connector drawn from and aligned with and in the same plane as the first end wall and the second tab connector drawn from and aligned with and in the same plane as the second end wall, the fastening device having multiple adjustment slots in the base, wherein the first and second tab connectors are configured for connection of the fastening device to another opposing and identically configured fastening device by insertion of the first or second tab connector through corresponding slots in the base of the opposing fastening device.

2. The fastening device of claim 1, in combination with a second fastening device of the identical configuration, the two fastening devices connected together in an opposed arrangement wherein the bases of the fastening devices are in an abutting arrangement and respective walls of the fastening devices extending in opposite directions, and the tab of each fastening device positioned within a respective adjustment slot of the other fastening device, and wherein the first end wall and corresponding first tab connector is spaced from and not engaged with the second fastening device.

3. A fastening device assembly for fastening a frame member to a support member, the fastening device assembly comprising a pair of identically configured fastening devices, each fastening device comprising a base having a plurality of edges; an attachment wall which extends perpendicularly from an edge of the base platform, the attachment wall further comprising straps which extend laterally from the attachment wall and configured for attachment to the support member; an opposing wall which extends perpendicularly from an edge of the base platform generally parallel and opposed to the attachment wall for positioning proximate to the support member; first and second end walls which extend perpendicularly from generally opposite edges of the base platform and which are generally perpendicular to the attachment wall and to the opposing wall for positioning proximate to generally opposed surfaces of the frame member, first and second tab connectors each extending from the base, the first tab connector drawn from and aligned with and in the same plane as the first end wall, and the second tab connector drawn from and aligned with and in the same plane as the second end wall, each tab connector configured for connection of the fastening device to another opposing and identically configured fastening device by insertion through corresponding slots in the base of the opposing fastening device; each fastening device having multiple corresponding slots in the base whereby insertion of one of the first or second tab connectors into one of the corresponding slots defines a fastening device assembly of a fixed width which extends from the first end wall of one fastening device to the second end wall of the opposing fastening device.

4. The fastening device assembly of claim 3 wherein each fastening device has ten corresponding slots in the base configured for receiving a tab connector of the other fastening device.

5. The fastening device assembly of claim 4 wherein the ten corresponding slots are located in the base to define ten different total widths of the fastening device assembly including: about 6¼ inches, about 6¾ inches, about 7¼ inches, about 7¾ inches, about 8¼ inches, about 8¾ inches, about 9¼ inches, about 9¾ inches, about 10¼ inches and about 10¾ inches.

6. The fastening device assembly of claim 3 wherein a tab connector of one fastening device is inserted into a corresponding slot in the base of an identically configured fastening device to form a fastening device assembly which has a total width of one of the width dimensions selected from the group of: about 6¼ inches, about 6¾ inches, about 7¼ inches, about 7¾ inches, about 8¼ inches, about 8¾ inches, about 9¼ inches, about 9¾ inches, about 10¼ inches and about 10¾ inches.

* * * * *